US012768549B2

(12) United States Patent
Hsu

(10) Patent No.: US 12,768,549 B2
(45) Date of Patent: Oct. 20, 2026

(54) REDUCTIVE DEHUMIDIFIER WITH BUILT-IN HEATING DEVICE

(71) Applicant: DRYTECH CORPORATION LTD., Tainan City (TW)

(72) Inventor: Tsang-Hung Hsu, Tainan City (TW)

(73) Assignee: DRYTECH CORPORATION LTD., Tainan City (TW)

( * ) Notice: Subject to any disclaimer, the term of this patent is extended or adjusted under 35 U.S.C. 154(b) by 417 days.

(21) Appl. No.: 18/433,693

(22) Filed: Feb. 6, 2024

(65) Prior Publication Data

US 2025/0251155 A1 Aug. 7, 2025

(51) Int. Cl.
*F24F 3/14* (2006.01)

(52) U.S. Cl.
CPC ..... *F24F 3/1411* (2013.01); *F24F 2003/144* (2013.01); *F24F 2003/1458* (2013.01)

(58) Field of Classification Search
CPC ..... F24F 3/1411; F24F 2003/144; F24F 2003/1458
See application file for complete search history.

(56) References Cited

U.S. PATENT DOCUMENTS 6,364,942 B1 * 4/2002 Felber ..... B01D 53/261 96/111
6,675,492 B2 * 1/2004 Hsu ..... F24F 3/1411 34/79
2008/0102744 A1 * 5/2008 Moore ..... B01D 53/30 454/249
2012/0118143 A1 * 5/2012 Foreman ..... B01D 53/261 96/111
2013/0240173 A1 * 9/2013 Line ..... B60H 3/024 165/104.34
2016/0061475 A1 * 3/2016 Ito ..... F24F 3/1411 62/271
2017/0205089 A1 * 7/2017 Fukuhara ..... F24F 3/001
2017/0225866 A1 * 8/2017 Humm ..... H02K 9/00
2018/0126323 A1 * 5/2018 Peterson ..... B01D 53/261
2022/0113042 A1 * 4/2022 Horie ..... F24F 1/0358

FOREIGN PATENT DOCUMENTS

CN 208794586 U 4/2019
TW 431585 U 4/2001

* cited by examiner

*Primary Examiner* — David J Laux
(74) *Attorney, Agent, or Firm* — Rosenberg, Klein & Lee

(57) ABSTRACT

The invention relates to a reductive dehumidifier with a built-in heating device, which includes a hygroscopic ingot and a heating device. The hygroscopic ingot includes a hygroscopic ingot body, which is an ingot-shaped structure made of porous hygroscopic material as the main component and solidified by pressing and molding with a mold. The heating device includes a heating element, a wire, and a power connector. The heating element is electrically connected with the power connector through the wire. The heating element is embedded inside the hygroscopic ingot body. When the hygroscopic ingot absorbs the moisture in the environment and reaches saturation amount, the heating element can generate heat energy, and the moisture in the hygroscopic ingot body will be evaporated and dried to restore the moisture absorption efficiency, so as to form the reductive dehumidifier with the built-in heating device that does not require a shell to accommodate hygroscopic materials.

20 Claims, 3 Drawing Sheets

REDUCTIVE DEHUMIDIFIER WITH BUILT-IN HEATING DEVICE

BACKGROUND OF THE PRESENT INVENTION

Field of Invention

The present invention relates to the field of dehumidification, and in particular, to a dehumidifier that evaporates and dries the moisture absorbed by the hygroscopic ingot in a heating manner to restore its moisture-absorbing efficiency and does not require a shell to accommodate the hygroscopic ingot.

Description of Related Arts

The principle of the reductive dehumidifier that can be used repeatedly to absorb moisture is that when the hygroscopic material absorbs the moisture in the environment and reaches a saturated amount and loses its hygroscopic effect, the moisture in the hygroscopic material can be evaporated by heating the hygroscopic material to restore dryness, thus providing repeated moisture-absorbing functions.

For example, TW 431585, CN 208794586, and U.S. Pat. No. 6,675,492 are all dehumidifiers that can be used repeatedly to absorb moisture by using a heating device to dry and restore the hygroscopic material after it reaches saturation.

However, in the above-mentioned previous patents, the hygroscopic materials are composed of many loose granules. In order to collect many freely rolling granular hygroscopic materials, a shell molded from plastic or metal must be provided structurally to accommodate these numerous granular hygroscopic materials in one shell. In addition, the granular hygroscopic materials used in the above-mentioned previous patents have extremely poor heat conduction effects due to the small contact area between particles. Therefore, it is necessary to set up a thermal conduction plate to disperse the heat energy of the heating element to the thermal conduction plate, and then use the thermal conduction plate to indirectly disperse the heat energy to all corners of the shell, so that the hygroscopic materials in each corner of the shell can be dried only after receiving sufficient heat energy.

The design of the hygroscopic materials using loose granules in the above-mentioned previous patents has the following shortcomings in practical use:

1. Manufacturers need to produce separately a shell to contain the loose particle hygroscopic material, which not only wastes the material and manufacturing cost of the shell, but also requires additional time for packaging the loose particle hygroscopic material inside the shell to prevent them from falling out of the shell, thus reducing assembly efficiency and increasing labor costs. In addition, the shell acts as a barrier between the hygroscopic material and the outside air, reducing the contact area between the hygroscopic material and the outside air and, therefore, reducing the hygroscopic material's efficiency.
2. When the product is discarded, in addition to increasing the amount of waste from the shell, the shell must be disassembled for waste sorting during recycling, which is quite inconvenient.
3. The contact area between many granular hygroscopic materials is small, so the heat conduction in the drying reduction process is slow and requires more time to complete the drying reduction, which not only wastes time but also increases energy consumption.
4. In order to accelerate the heat conduction during the drying reduction process, a heat conduction plate with rapid thermal conductivity is installed in the shell. However, the installation of the heat conduction plate increases the manufacturing cost of the dehumidifier.

Therefore, the inventor developed the present invention in view of the shortcomings of the above-mentioned previous patents, which include many parts, complicated assembly procedures, increased manufacturing costs, and inconvenient recycling.

SUMMARY OF THE PRESENT INVENTION

One of the objects of the present invention is to provide a reductive dehumidifier with a built-in heating device, which presses a porous hygroscopic material to form a solidified columnar or block-shaped ingot-shaped structure with a mold, so that the hygroscopic material does not need to use a shell to package the granular hygroscopic material, forming a dehumidifier that does not need a shell to encapsulate the hygroscopic material. In addition to saving the material and assembly costs of the shell, the hygroscopic material is not blocked by the shell and can have a larger contact area with the outside air, thereby absorbing moisture more quickly and producing better moisture absorption effects.

The second object of the present invention is to provide a reductive dehumidifier with a built-in heating device, which is to embed a heating element inside the ingot-shaped hygroscopic material that can directly heat, dry and restore the ingot-shaped hygroscopic material. In addition to eliminating the traditional need for the heating element to indirectly heat the hygroscopic material through the heat conduction plate, it further allows the heating element to be tightly and fully covered by the hygroscopic material, and directly heats the hygroscopic material, so that the hygroscopic material has a better heating effect, thereby improving the efficiency of the drying process.

The third object of the present invention is to provide a reductive dehumidifier with a built-in heating device, which is to high-pressure form a solidified columnar or block-shaped hygroscopic ingot of powdered porous hygroscopic material with a mold, so that the hygroscopic ingot forms a structure with a relatively compact structure, and then the hygroscopic ingot has a better heat conduction ability, to fully absorb the heat energy generated by the heating element and diffuse to the overall hygroscopic ingot, so that the time of heating reduction and drying can be shortened, and then the energy-saving effect is achieved.

The above-mentioned object of the present invention is achieved through the following technologies:

A reductive dehumidifier with a built-in heating device, which includes a hygroscopic ingot and a heating device arranged thereon respectively, wherein the hygroscopic ingot includes a hygroscopic ingot body, which is the porous hygroscopic material that is ground into powder form as the main component, then cooperates with an adhesive to be pressed and formed with a mold under high pressure, and then be solidified in the ingot-shaped structure by drying, wherein the heating device includes a heating element, a wire and a power connector, wherein the heating element is electrically connected with the power connector through the wire, wherein the heating element is tightly buried in the hygroscopic ingot body, wherein the power connector is switched on to energize the heating element through the wire, generating heat energy to heat and dry the hygroscopic ingot body, thus restoring the moisture absorption efficiency of the hygroscopic ingot body.

The reductive dehumidifier with the built-in heating device as described above, the hygroscopic ingot body has a rough surface that is capable of increasing the hygroscopic surface area.

The reductive dehumidifier with the built-in heating device as described above, the hygroscopic ingot includes an upper base combined with an upper end of the hygroscopic ingot body, wherein the hygroscopic ingot includes a humidity sensing component arranged on the upper base.

The reductive dehumidifier with the built-in heating device as described above, the humidity sensing component is a moisture-absorbing color-changing component.

The reductive dehumidifier with the built-in heating device as described above, the upper base has a chamber disposed therein, and the moisture-absorbing color-changing component is accommodated in the chamber, wherein the chamber has a through hole arranged at a bottom thereof, so that the chamber is communicated with the hygroscopic ingot body through the through hole, wherein the upper base includes a transparent cover covering on the chamber.

The reductive dehumidifier with the built-in heating device as described above, the hygroscopic ingot includes a lower base combined with a lower end of the hygroscopic ingot body, wherein the power connector is provided on the lower base.

The advantages of the present invention include:

1. The present invention directly forms the hygroscopic material into a columnar or block-shaped ingot, which eliminates the need to encapsulate the shell around the hygroscopic material, thereby reducing the shell material and assembly process and reducing production costs.
2. Since the present invention directly molds the hygroscopic material into a columnar or block-shaped ingot, there is no need to encapsulate it with a shell of plastic or other materials. Therefore, when the product is discarded, the garbage generation can be reduced, or when the resource is recovered, there is no need to do the action of dismantling the shell, and the recycling is convenient.
3. Since the hygroscopic ingot of the present invention does not need to be encapsulated or covered with a shell of any material, the hygroscopic material is not blocked by the shell and can obtain a complete contact area with the outside air, and then can adsorb moisture more quickly, produce a better moisture absorption effect.
4. Since the present invention buries the heating element for drying and reduction inside the hygroscopic ingot, the heating element is tightly and fully covered by the hygroscopic material, eliminating the need to use the traditional heat conduction plate to indirectly heat the hygroscopic material, and directly heat the hygroscopic material, so that hygroscopic material has better heating effects, thereby improving the efficiency of drying treatment.

Due to the use of molds in the present invention, the fine powdery porous hygroscopic material is formed by high-pressure pressing to form a solidified columnar or block-shaped hygroscopic ingot, resulting in a tightly structured connection of the hygroscopic ingot material. Therefore, it has better thermal conductivity and can shorten the heating, drying, and reduction time, thereby achieving energy-saving effects.

DETAILED DESCRIPTION OF THE PREFERRED EMBODIMENT

Figure 1:
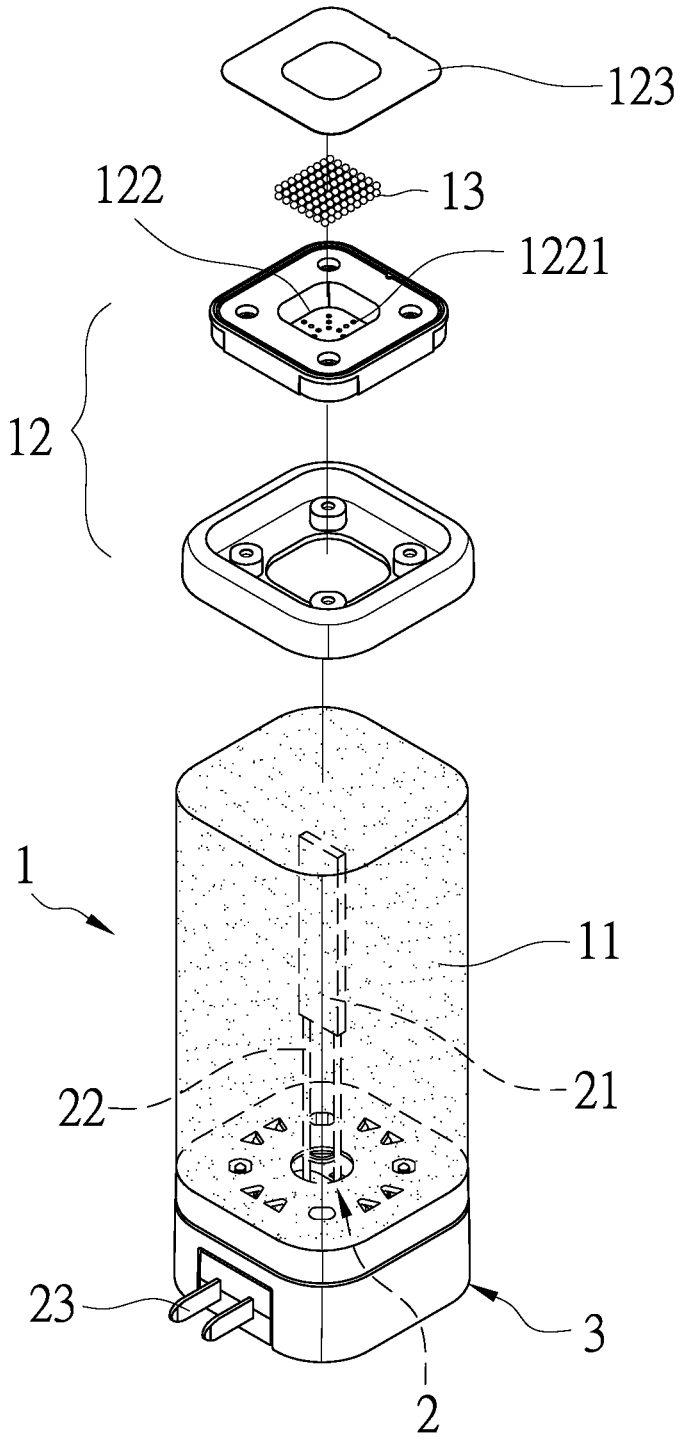
FIG. 1 is an exploded view of a reductive dehumidifier with a built-in heating device according to the present invention.
Figure 2:
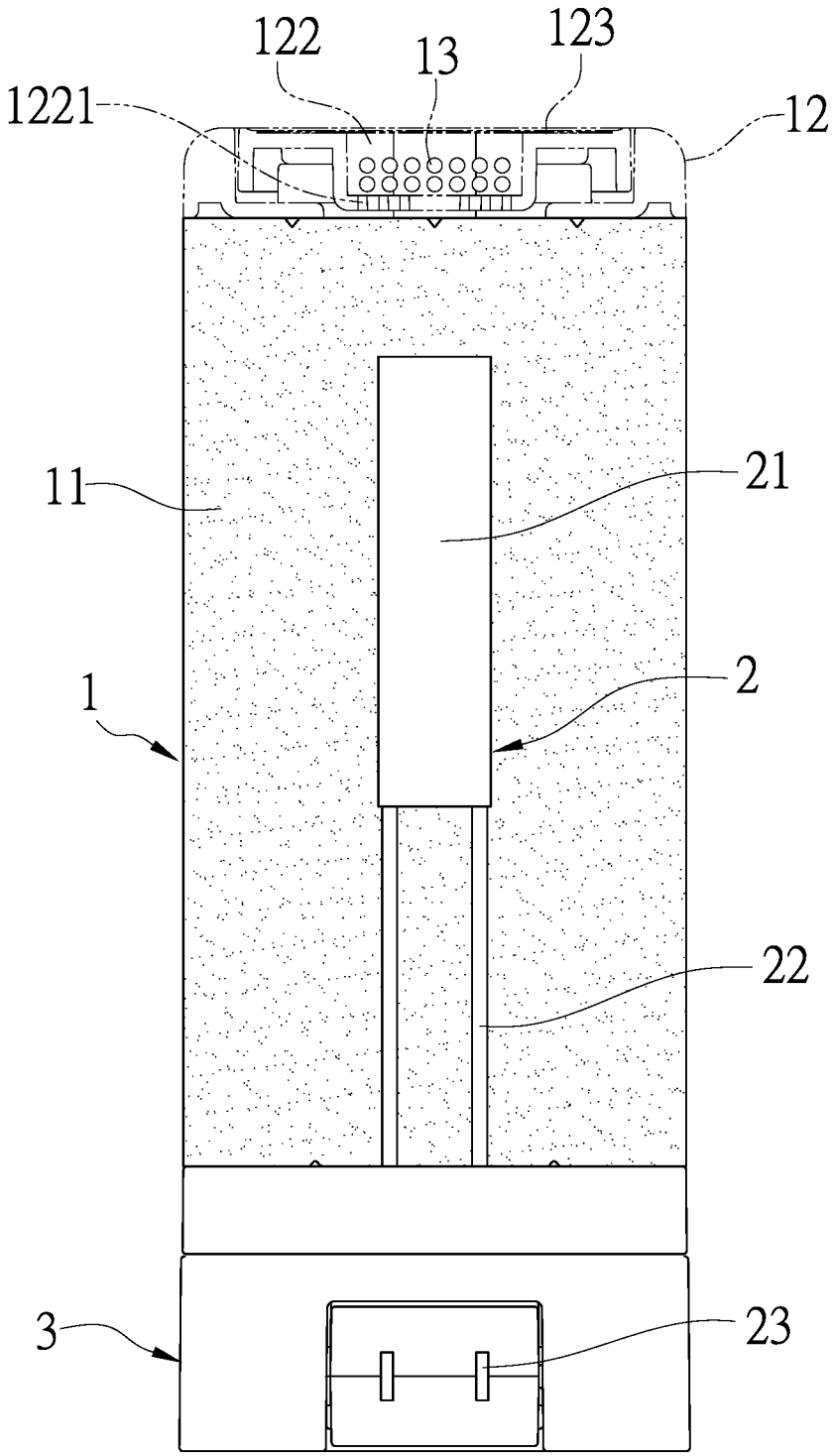
FIG. 2 is an assembled sectional view of the reductive dehumidifier with the built-in heating device according to the present invention.
Figure 3:
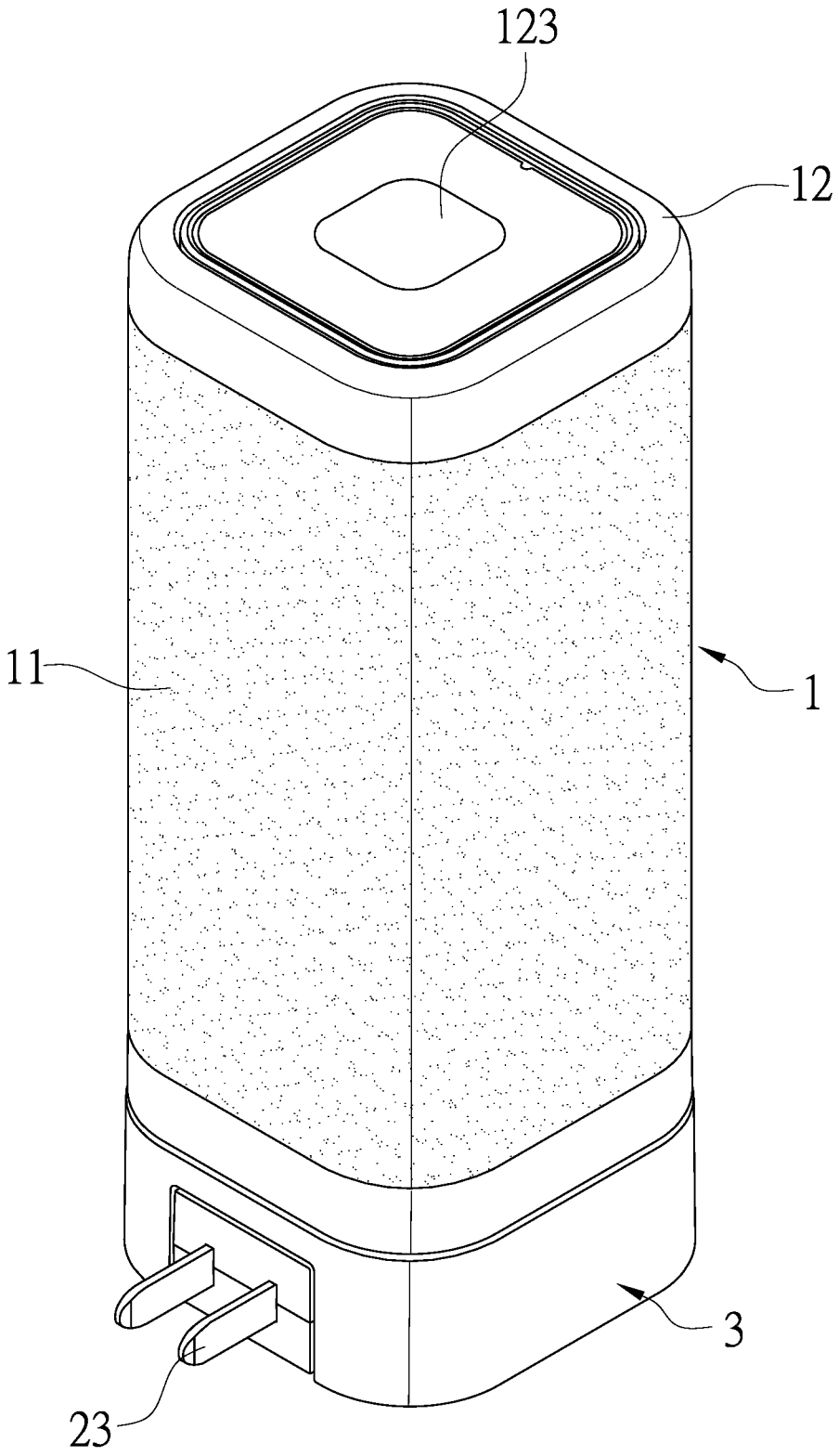
FIG. 3 is an assembled perspective view of the reductive dehumidifier with the built-in heating device according to the present invention.

Referring to FIGS. 1-3.

The reductive dehumidifier with built-in heating device of the present invention includes a hygroscopic ingot 1 and a heating device 2, wherein

- the hygroscopic ingot 1 includes a hygroscopic ingot body 11, which is mainly composed of a porous hygroscopic material and is formed by mold pressing and solidified into a columnar or block-shaped ingot structure;
- the heating device 2 includes a heating element 21, a wire 22 and a power connector 23, wherein the heating element 21 is electrically connected with the power connector 23 through the wire 22, wherein the heating element 21 is buried inside the hygroscopic ingot body 11.

Accordingly, when the hygroscopic ingot body 11 is saturated with moisture, the power connector 23 can be switched on to energize the heating element 21 through the wire 22, generating heat to evaporate and dry the moisture inside the hygroscopic ingot body 11, thus restoring the moisture absorption efficiency of the hygroscopic ingot body 11.

In addition, in a preferred embodiment of a reductive dehumidifier with a built-in heating device of the present invention, the hygroscopic ingot body 11 has a rough surface, so that the hygroscopic surface area of the hygroscopic ingot body 11 is increased through the rough surface to enhance the hygroscopic effect.

In a preferred embodiment of a reductive dehumidifier with a built-in heating device in the present invention, the main component of the hygroscopic ingot body 11 is a porous hygroscopic material that is formed into an ingot-shaped structure with moisture absorption capacity by mold pressing. A shell-less dehumidifier that does not require a shell to house hygroscopic material can be formed. However, a breathable fabric material with good aesthetics and texture can also be coated on the surface of the ingot-shaped structure to enhance the appearance and quality of the dehumidifier.

In a preferred embodiment of the reductive dehumidifier with the built-in heating device of the present invention, the heating element 21 is integrally embedded inside the hygroscopic ingot body 11 when the hygroscopic ingot body 11 is pressed and formed. Therefore, the heating element 21 is fully covered by the hygroscopic material, and adheres closely to each other as the hygroscopic material solidifies, so that the hygroscopic material can obtain a better heating effect and shorten the time for heating, drying and restoring the hygroscopic ingot body 11. In addition, it is also possible to form a slot in the solidified hygroscopic material, and the heating element 21 is placed in the slot. At the same time, a caulking material can be applied between the solidified hygroscopic material and the heating element 21, so that the hygroscopic material and the heating element 21 are indirectly and closely attached to each other through the caulking material, ensuring that the hygroscopic material obtains a better heating effect.

In a preferred embodiment of the reductive dehumidifier with the built-in heating device of the present invention, the hygroscopic ingot 1 also includes an upper base 12 and a lower base 3. The upper base 12 is coupled to the upper end of the hygroscopic ingot body 11, and the lower base 3 is coupled to the lower end of the hygroscopic ingot body 11.

In a preferred embodiment of the reductive dehumidifier with the built-in heating device of the present invention, the hygroscopic ingot 1 further includes a humidity sensing component 13. The humidity sensing component 13 is located on the upper base 12. The humidity sensing component 13 is used to determine the degree of moisture absorption saturation of the hygroscopic ingot body 11. Usually, the humidity sensing component 13 includes a moisture-absorbing color-changing component, which is a moisture-sensitive color-changing material that changes color as the degree of moisture absorption of the hygroscopic ingot body 11 increases, allowing the user to directly identify the color change of the moisture-sensitive color-changing material and determine whether the hygroscopic ingot body 11 needs to be heated, dried, and restored.

In a preferred embodiment of the reductive dehumidifier with the built-in heating device of the present invention, the upper base 12 has a chamber 122 disposed therein, and the humidity sensing component 13 is accommodated in the chamber 122. The chamber 122 has a through hole 1221 at a bottom thereof, so that the chamber 122 is communicated with the hygroscopic ingot body 11 through the through hole 1221. The upper base 12 also includes a transparent cover 123 covering the chamber 122 so that the humidity sensing component 13 is reliably placed in the chamber 122. Therefore, the humidity sensing component 13 can sense the degree of moisture absorption of the hygroscopic ingot body 11, and produce color changes according to the degree of moisture absorption. The user can judge whether the hygroscopic ingot body 11 needs to be heated, dried, and reduced by observing the color of the humidity sensing component 13 through the transparent cover 123.

In a preferred embodiment of the reductive dehumidifier with the built-in heating device of the present invention, the power connector 23 is provided on the lower base 3.

That is, when the hygroscopic ingot body 11 needs to be heated, dried, and reduced, the power connector 23 is directly energized, so that the heating element 21 generates heat energy through the energizing of the wire 22, and the water in the hygroscopic ingot body 11 is evaporated and dried by the heat energy, so as to restore the hygroscopic efficiency of the hygroscopic ingot body 11.

What is claimed is:

1. A reductive dehumidifier with a built-in heating device, comprising a hygroscopic ingot and a heating device arranged thereon respectively, wherein the hygroscopic ingot comprises a hygroscopic ingot body, which is an ingot-shaped structure made of a porous hygroscopic material as the main component and solidified by pressing and molding with a mold, wherein the heating device comprises a heating element, a wire and a power connector, wherein the heating element is electrically connected with the power connector through the wire, wherein the heating element is buried in the hygroscopic ingot body and is covered by the solidified hygroscopic material, wherein the power connector is switched on to energize the heating element through the wire, generating heat energy to heat and dry the hygroscopic ingot body, thus restoring the moisture absorption efficiency of the hygroscopic ingot body.

2. The reductive dehumidifier with the built-in heating device as claimed in claim 1, wherein the hygroscopic ingot body has a rough surface that is capable of increasing the hygroscopic surface area.

3. The reductive dehumidifier with the built-in heating device as claimed in claim 2, wherein the hygroscopic ingot comprises an upper base combined with an upper end of the hygroscopic ingot body.

4. The reductive dehumidifier with the built-in heating device as claimed in claim 3, wherein the hygroscopic ingot comprises a humidity sensing component arranged on the upper base.

5. The reductive dehumidifier with the built-in heating device as claimed in claim 4, wherein the humidity sensing component is a moisture-absorbing color-changing component.

6. The reductive dehumidifier with the built-in heating device as claimed in claim 5, wherein when the heating element is embedded inside the hygroscopic ingot body, the heating element and the solidified hygroscopic material are directly and closely attached to each other.

7. The reductive dehumidifier with the built-in heating device as claimed in claim 6, wherein the hygroscopic ingot comprises a lower base combined with a lower end of the hygroscopic ingot body.

8. The reductive dehumidifier with the built-in heating device as claimed in claim 7, wherein the power connector is provided on the lower base.

9. The reductive dehumidifier with the built-in heating device as claimed in claim 8, wherein the hygroscopic ingot body is capable of being covered with a breathable fabric material.

10. The reductive dehumidifier with the built-in heating device as claimed in claim 5, wherein the hygroscopic ingot body is capable of being covered with a breathable fabric material.

11. The reductive dehumidifier with the built-in heating device as claimed in claim 5, wherein when the heating element is buried inside the hygroscopic ingot body, a caulking material is applied between the solidified hygroscopic material and the heating element to indirectly and closely adhere to each other.

12. The reductive dehumidifier with the built-in heating device as claimed in claim 11, wherein the hygroscopic ingot comprises a lower base combined with a lower end of the hygroscopic ingot body.

13. The reductive dehumidifier with the built-in heating device as claimed in claim 12, wherein the power connector is provided on the lower base.

14. The reductive dehumidifier with the built-in heating device as claimed in claim 1, wherein when the heating element is embedded inside the hygroscopic ingot body, the heating element and the solidified hygroscopic material are directly and closely attached to each other.

15. The reductive dehumidifier with the built-in heating device as claimed in claim 14, wherein the hygroscopic ingot comprises a lower base combined with a lower end of the hygroscopic ingot body.

16. The reductive dehumidifier with the built-in heating device as claimed in claim 15, wherein the power connector is provided on the lower base.

17. The reductive dehumidifier with the built-in heating device as claimed in claim 1, wherein when the heating element is buried inside the hygroscopic ingot body, a caulking material is applied between the solidified hygroscopic material and the heating element to indirectly and closely adhere to each other.

18. The reductive dehumidifier with the built-in heating device as claimed in claim 17, wherein the hygroscopic ingot comprises an lower base combined with a lower end of the hygroscopic ingot body.

19. The reductive dehumidifier with the built-in heating device as claimed in claim 18, wherein the power connector is provided on the lower base.

20. The reductive dehumidifier with the built-in heating device as claimed in claim 1, wherein the hygroscopic ingot body is capable of being covered with a breathable fabric material.

* * * * *